US005230191A

United States Patent [19]

Mayrand

[11] Patent Number: 5,230,191

[45] Date of Patent: Jul. 27, 1993

[54] PRECAST INSULATED CONCRETE PANEL FOR PREFABRICATED BUILDING STRUCTURE

[76] Inventor: Paul Mayrand, 4253 Moïse Picard, Montreal, Quebec, Canada

[21] Appl. No.: 706,038

[22] Filed: May 28, 1991

[51] Int. Cl.[5] ..... E04B 1/60

[52] U.S. Cl. ..... 52/309.12; 52/259; 52/612; 52/331

[58] Field of Search ..... 52/309.12, 251, 252, 52/259, 262, 453, 327, 331-334, 612

[56] References Cited

U.S. PATENT DOCUMENTS

| | | | |
|---|---|---|---|
| 2,708,300 | 5/1955 | Buttress . | |
| 3,952,471 | 4/1976 | Mooney . | |
| 4,112,173 | 2/1977 | Roudebush et al. . | |
| 4,127,971 | 12/1978 | Rojo, Jr. | 52/259 X |
| 4,142,340 | 3/1979 | Howard | 52/612 X |
| 4,512,126 | 4/1985 | Walston | 52/309.12 X |
| 4,811,770 | 3/1989 | Rapp | 52/309.12 |
| 4,841,702 | 6/1989 | Huettemann . | |
| 4,875,322 | 10/1989 | Rozzi | 52/309.12 |
| 4,942,707 | 7/1990 | Huettemann | 52/309.12 |
| 4,944,127 | 7/1990 | Clear | 52/309.12 X |

FOREIGN PATENT DOCUMENTS

| | | | |
|---|---|---|---|
| 1709371 | 5/1973 | Fed. Rep. of Germany | 52/309.12 |
| 2378143 | 8/1978 | France . | |
| 2382552 | 9/1978 | France . | |
| 2562583 | 11/1985 | France . | |
| 676408 | 7/1952 | United Kingdom . | |

*Primary Examiner*—Richard E. Chilcot, Jr.

[57] ABSTRACT

A precast insulated concrete panel and a method of forming same and a building structure incorporating such panel is described. The precast insulated concrete panel is comprised of an outer insulating skin formed by a rigid layer of insulating sheet foam material connected to a concrete inner wall layer cast on the inner surface of the insulating material. The inner surface of the insulating material has connecting cavities formed therein so that the concrete flows into the cavity and connects to the rigid insulating material through integral plugs of concrete which are set formed with the connecting cavities. Connectors are also formed in the concrete and in the insulation to connect and manipulate the panels and to attach outer finishing building materials to the insulation. These panels may be utilized in a tilt-up construction method and connect to floor slabs to form building structures of more than one storey.

14 Claims, 27 Drawing Sheets

PRECAST INSULATED CONCRETE PANEL FOR PREFABRICATED BUILDING STRUCTURE

BACKGROUD INVENTION

1. Field of the Invention

The present invention relates to a precast insulated building construction panel and method of making same for constructing concrete building structures.

2. Description of Prior Art

It is known to build concrete building structures by interconnecting wall and floor panels together. The building structures are assembled by various methods such as placing the panels in position with the assistance of a crane and connecting the panels while they are supported.

Another method of assembling precast concrete building structures is identified by the "tilt-up method". In this latter method, the wall panels are pivoted to their vertical position on a footing and interconnected. However, this latter method has been utilized for building large structures such as commercial buildings where the concrete panels are utilized only for the outside or some internal division walls to construct a one-storey building. Any internal flooring structure is supported on the floor slab and not by the outside walls. With such a method, the concrete is exposed to the exterior and it becomes very difficult to insulate the wall panels. The panels are usually left bare on the exterior and may be sandblasted or given an exterior treatment, but usually it is the concrete that is exposed. Insulation has been applied to the interior surface of the walls but this has posed various thermal insulation problems and the fabrication cost is high. For this reason, the tilt-up method has been utilized in temperate climatic zones where insulation of the panels is not critical.

SUMMARY OF INVENTION

It is therefor a feature of the present invention to provide a precast insulated concrete panel for use in a concrete building structure which substantially overcomes all of the above-mentioned disadvantages of the prior art.

Another feature of the present invention is to provide a precast insulated concrete panel for use in the fabrication of concrete building structures using part of known the tilt-up method and wherein the building structure has more than one storey and the concrete is exposed to the inside of the building.

Another feature of the present invention is to provide a precast insulated concrete panel having an outer insulating skin formed by rigid insulating sheet foam material provided with connectors for attaching outer finishing building materials thereto.

Another feature of the present invention is to provide a precast insulated concrete panel wherein the panel is formed of an inner concrete surface which is adhered to an outer insulating skin by integral concrete plugs cast into the outer insulating material.

Another feature of the present invention is to provide a method of forming a precast insulated concrete panel wherein the concrete is cast over a rigid insulating foam layer and adhered thereto by cavities formed in the rigid insulating foam material and further wherein such panels may be cast one over other.

Another feature of the present invention is to provide a method of constructing a building structure with precast insulated concrete panels of the present invention and wherein the exterior panels have their concrete layer in the interior of the structure and are used to interconnect and support one or more stories of floor slabs.

According to the above features, from a broad aspect, the present invention provides a precast insulated concrete panel for use in a building structure. The panel comprises an outer insulating skin formed by a rigid layer of insulating sheet foam material. The insulating material has connecting cavities formed in an inner surface thereof. A concrete inner wall layer is formed on the inner surface and integral plugs of concrete being formed in the connecting cavities.

According to a still further broad aspect of the present invention, there is provided a method of forming a precast insulated concrete panel comprising the steps of providing a flat level surface on which the panel is to be cast. A form casing is placed on the level surface and rigid sheets of insulating foam material are then placed in the casing where concrete is to be poured to form an outer insulating skin. A plurality of cavities are formed in a top face of the rigid insulating foam material. The cavites extend part way in the insulating foam material. The concrete is then poured over the insulating material with the concrete entering the cavities. The panel is then cured so that the cured concrete connects to the rigid insulating material by forming concrete plugs in the cavities.

The method also envisages placing a second form casing over a top face of the concrete after a predetermined cured time and repeating the steps of inserting the rigid insulating foam material and pouring another layer of concrete to form another panel. If the cured time is relatively short, a plastic sheet can be interposed between the top surface of the panel and the form casing. Several panels can be cast one on top of the other using this method, and this is made possible by the use of the rigid foam material at the base of the casing to form an outer insulating skin layer on the concrete panels.

According to a still further broad aspect of the present invention, there is provided a method of constructing a building structure with precast insulated concrete panels. The method comprises the steps of forming a support footing to receive the concrete panels as vertical walls. The precast insulated concrete panels are cast with an outer insulating skin formed by a rigid layer of insulating sheet foam material. The panels define concrete inner walls which are connected with the foam material by connecting cavities formed in an inner surface of the sheet foam material so that integral concrete plugs are formed therein. The panels are placed vertically in a side-by-side relationship and interconnected together to form at least the vertical exterior walls of the building structure.

According to another broad aspect of the present invention, the method of constructing the building structure utilizes the precast insulated concrete panels of the present invention which are also provided with connecting means on the inner concrete layer of the panel to connect and support one or more stories of concrete floor slabs with the side walls being erected by the tilt-up method.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
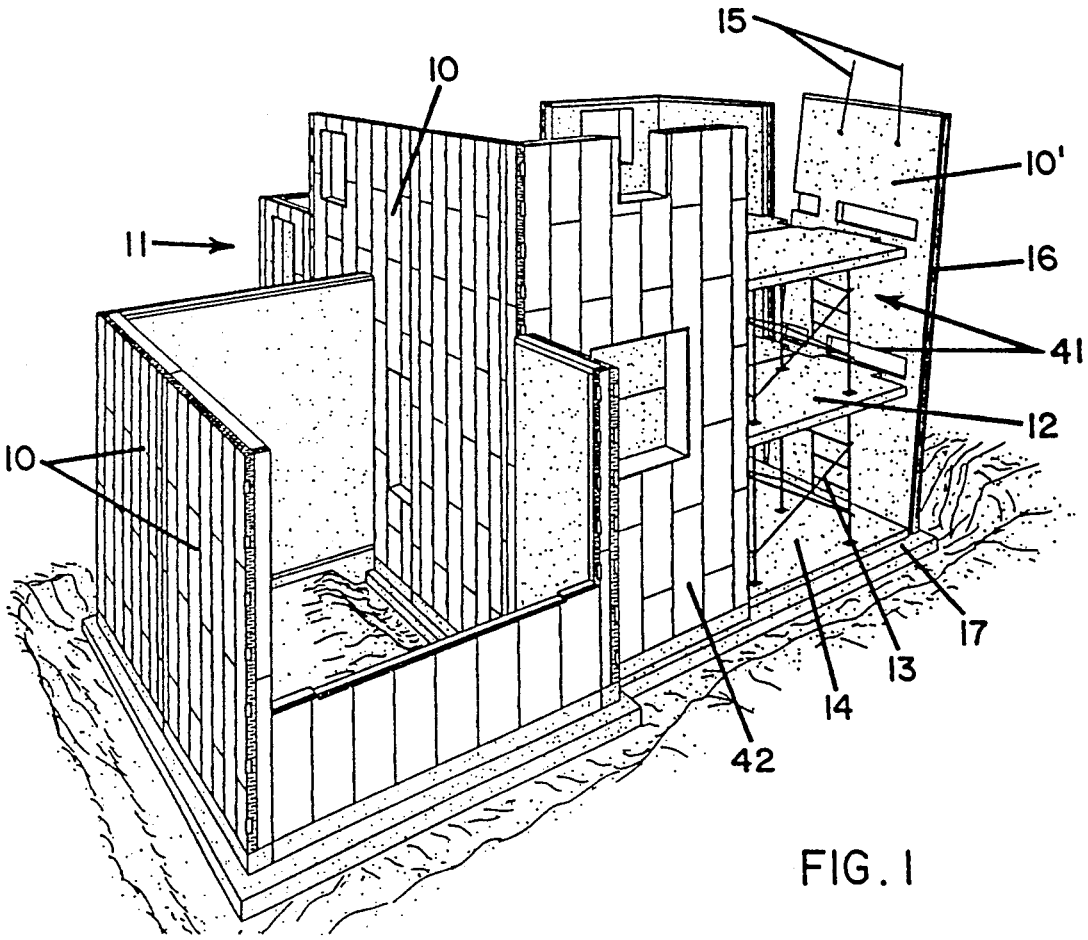
FIG. 1 is a perspective view of a building structure having sections thereof formed with more than one storey and being erected with the precast insulated concrete panels of the present invention.
Figure 2:
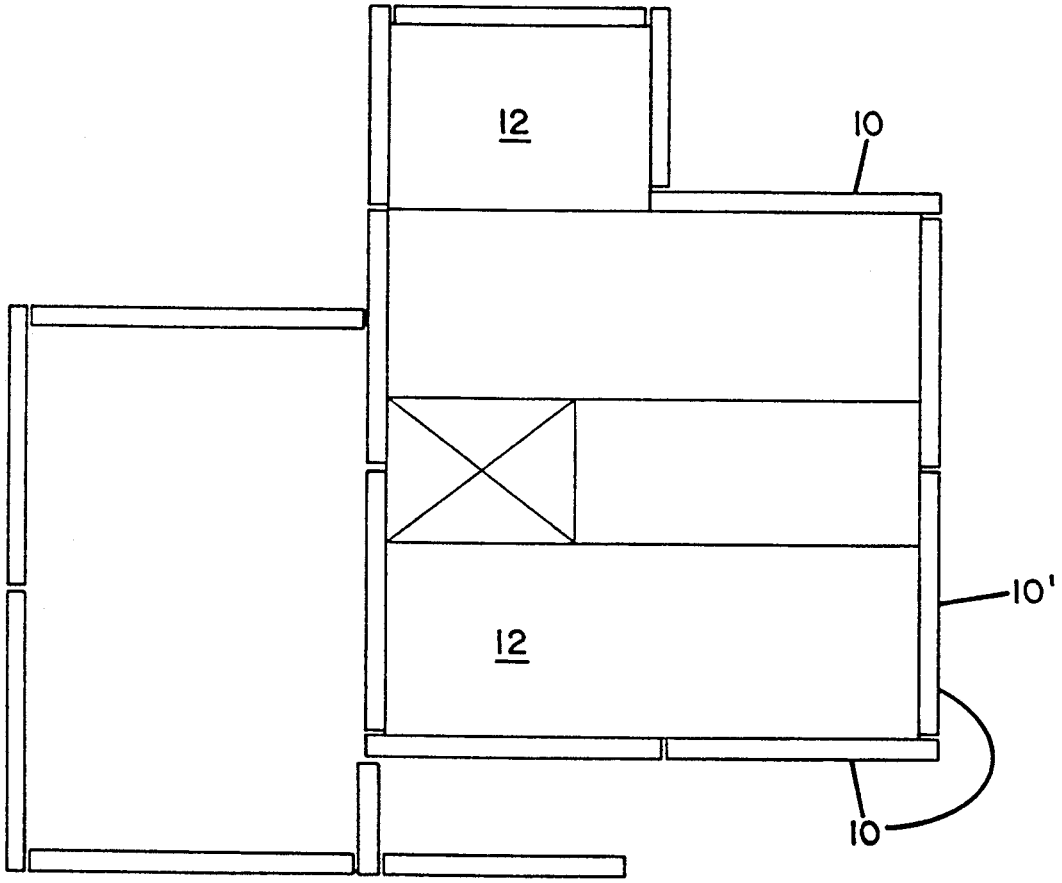
FIG. 2 is a floor plan illustrating the position of the outer walls of the building structure using precast insulated concrete panels of the present invention.
Figure 3:
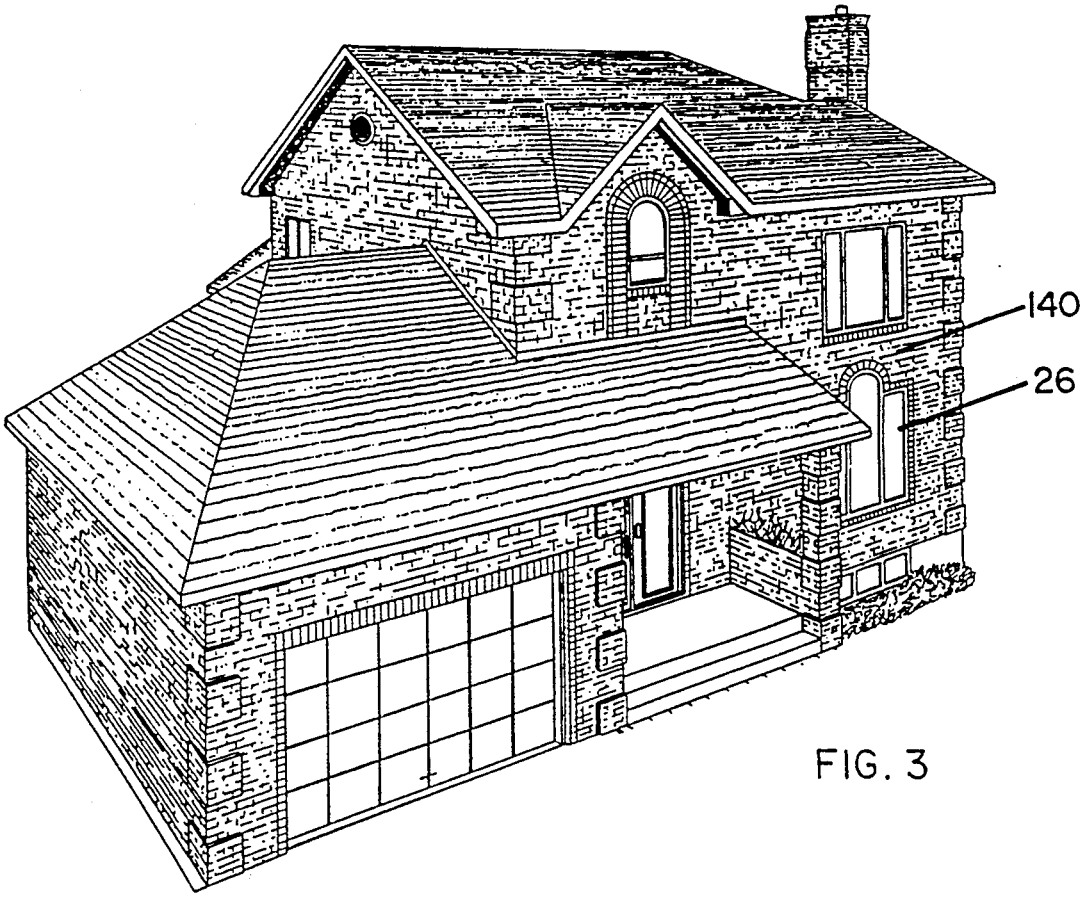
FIG. 3 is a perspective view of the prefabricated building structure illustrated in FIGS. 1 and 2 after completion.

Referring now to the drawings and more particularly to FIGS. 1 to 6, there is shown generally at 10, (see FIGS. 1 and 2, the precast insulated concrete panels of the present invention as used in the construction of a prefabricated building structure 11. As shown in FIG. 1, the building structure is provided, in a section thereof, as a three-storey structure formed by the concrete floor slabs 12, which are supported in position by scaffolding 13 positioned over a level concrete floor surface 14. As herein shown, the side wall panels 10 have different configurations to suit the architectyural design parameters. As also shown in FIG. 1, the side wall panels are erected by the tilt-up method with panel 10' being engaged by lifting cables 15 from a crane (not shown) used to tilt the panel upwardly in the direction of arrows 16 from its base which is supported on steel pads (not shown) positioned on the footing 17. With the construction method of the present invention, it is possible to cast the panels 10 on a level surface provided on the construction site. After the vertical walls are connected to the floor slabs, the building can be completed and may have an exterior finish as shown in FIG. 3.

Figure 6:
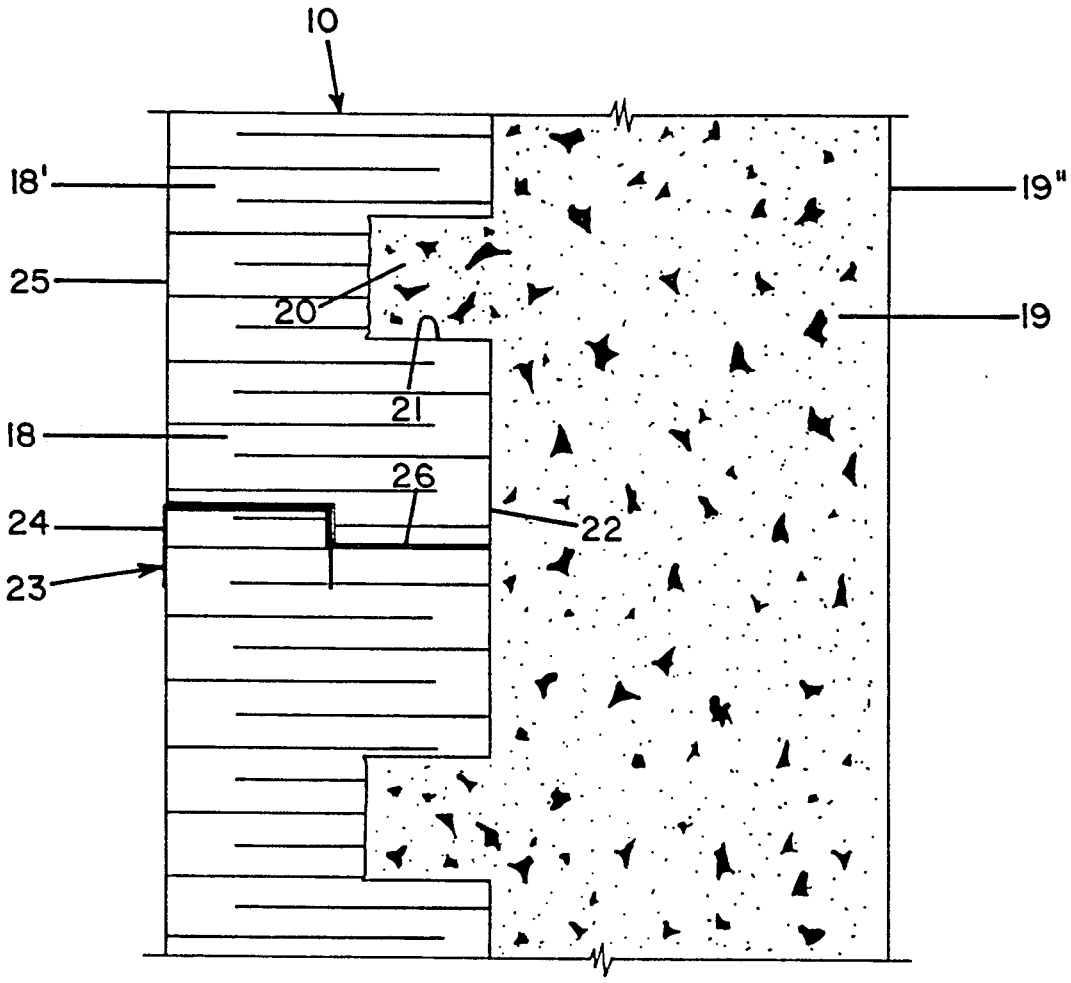
FIG. 6 is a fragmented section view of the precast insulated concrete panel of the present invention illustrating the manner in which the concrete layer is connected to the insulating foam layer.

The panels 10 are precast into its basic component parts as illustrated in FIG. 6 and comprised of an outer insulating skin 18 formed by a rigid layer of insulating sheet foam material 18', which constitutes the outer surface of the panel, and an inner concrete layer 19 which is adhered to the sheet foam material 18' by integral plugs of concrete 20 set into connecting cavities 21 formed on the inner surface 22 of the sheet foam material 18'. These integral plugs of concrete material form a positive connection between the inner concrete slab 19 and the outer insulating sheet foam material 18.

As shown in FIG. 6, the precast insulated concrete panel is also provided with a plurality of attachment elements, herein U-shape sheet metal inserts 23 which are positioned and secured in a joint of adjacent insulating sheets 18' of the foam material, and these are spaced apart therealong to provide outer connecting flanges 24 on the outer surface 25 of the insulating sheet 18. As herein shown the joint 26 is provided with an offset portion and the inner end of the U-shape sheet metal insert 23 extends only midway into the insulating skin 18. Accordingly, there is a thermal barrier formed between outer construction material connected to the outer connecting flange 24 and the inner concrete panel 19.

Figure 4A:
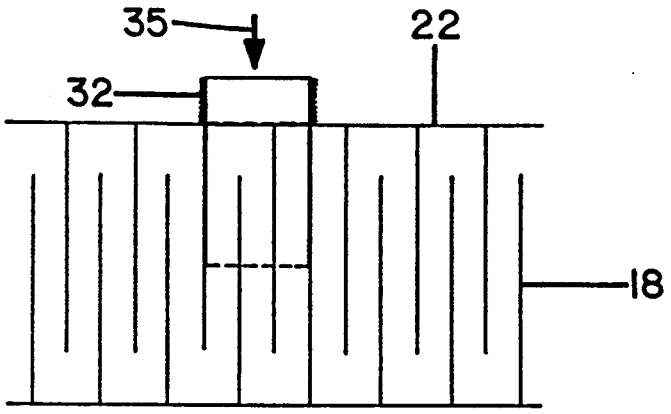
FIGS. 4A to 4C are side views illustrating the manner in which the connecting cavities are formed in the inner surface of the rigid insulating sheet foam material.
Figure 4B:
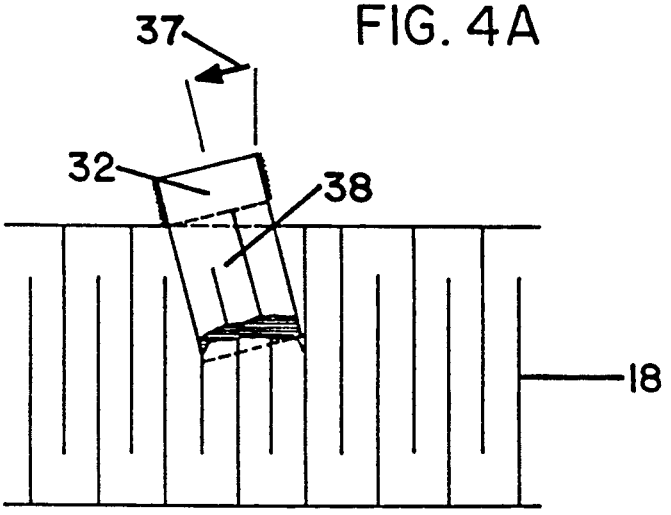
Figure 4C:
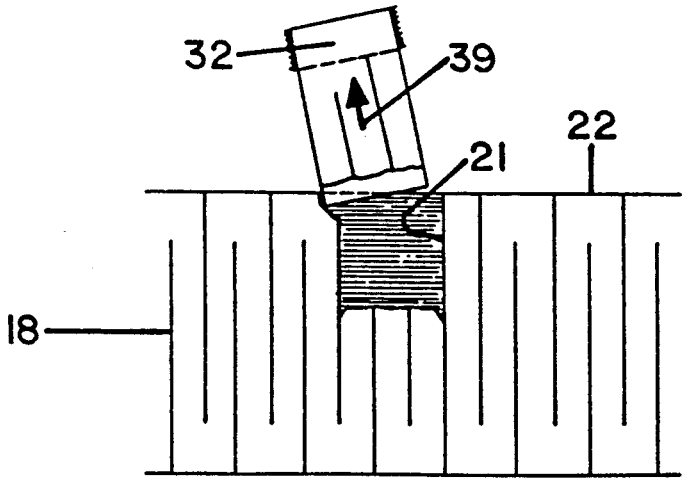
Figure 5:
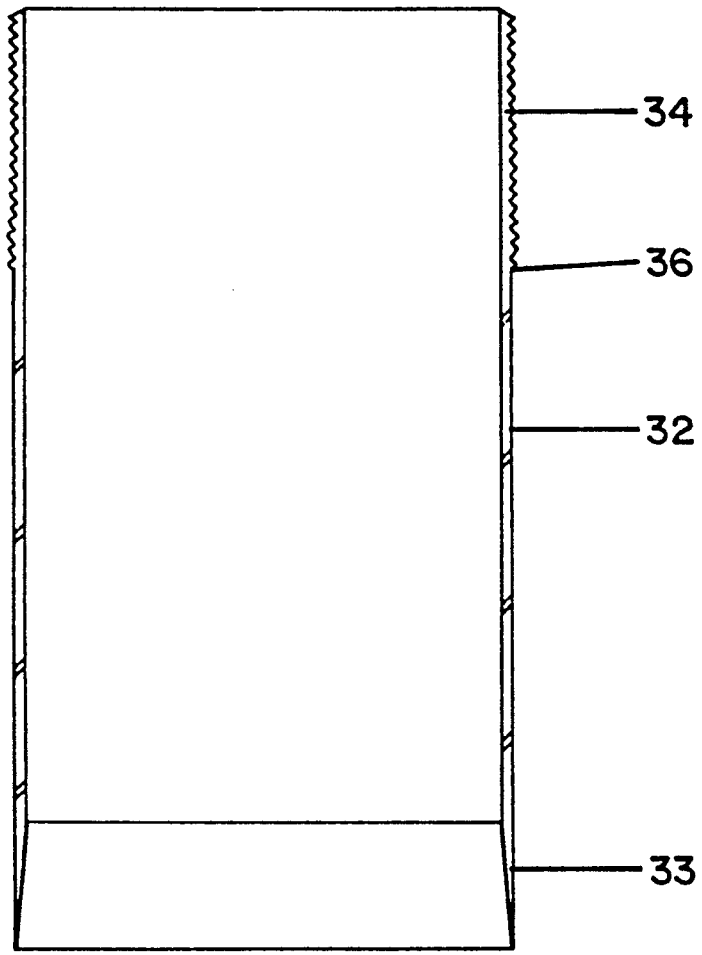
FIG. 5 is a section view of the hollow cylindrical cutting tool utilized to form the cavities in the insulating sheet foam material as shown in FIGS. 4A to 4C.
Figure 7:
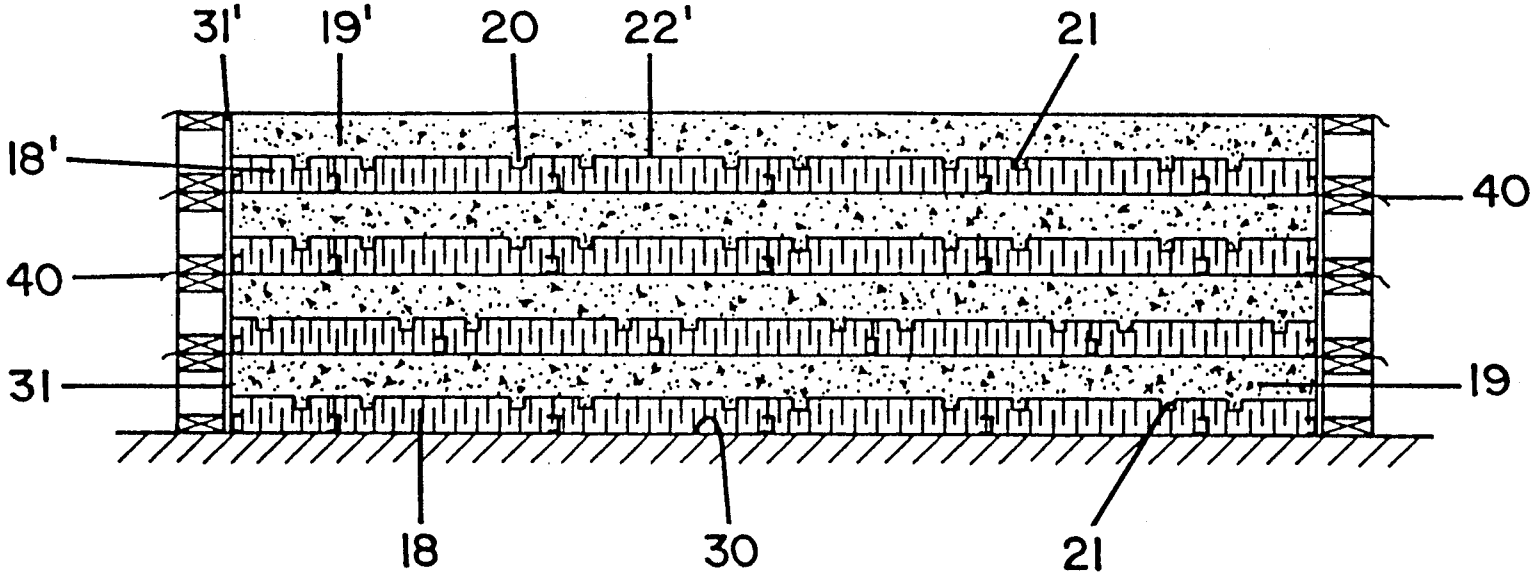
FIG. 7 is a simplified section view illustrating the manner in which the panels may be cast one on top of another.

Referring now more specifically to FIGS. 4, 5 and 7, there is shown the manner in which the panels 10 are produced. As shown in FIG. 7, it is firstly necessary to prepare a flat level surface 30 on which the panel is to be cast. A form casing 31 which may be constructed on wood, metal or other suitable material is then placed on the level surface 30. The form 31 will define the contour of the panel 10 and openings therein. The next step is to position rigid sheets of the foam material 18 into the casing where the concrete is to be poured to form the outer insulating skin of the panel. However, before pouring the concrete layer 19, it is inner face 22 of the foam sheets positioned within the form casing. This is done by the use of the hollow cylindrical cutting tool 32 as shown in FIG. 5.

As shown specifically in FIGS. 4 and 5, the cutting tool 32 is a hollow cylindrical tool having a sharp cylindrical cutting forward edge 33 and a grasping end 34. To make the connecting cavities 21, the tool 32 is inserted into the inner face 22 of the foam in the direction of arrow 35 as shown in FIG. 4A until it penetrates a predetermined distance which is defined by the lower end 36 of the gripping end 35 of the tool. The tool is then pushed sideways or in a rocking fashion as shown by arrow 37 in FIG. 4B until the foam plug 38 inside the tool 32 breaks from the rest of the foam sheet 18. The tool is then pulled upwardly in the direction of arrow 39 as shown in FIG. 4C and the plug 38 can then be removed from the hollow cylindrical tool 32 by simply pushing it out or repeating the process. Thus, the connecting cavity 21 is formed. The advantage of using this tool is that connecting cavities can be formed once the foam is placed in the casing and once the inserts for window or door openings or connecting cavities are formed in the foam 22 so that one can visualize where the best locations are to make these connections. A pattern can also be used to indicate where the cavities are to be located.

After the connecting cavitites 21 are made within the inner surface 22 of the foam sheet 18, reinforcing steel rods are assembled, if required, and concrete 19 is then poured into the form casing to its specific level. The concrete enters the cavities 21 and form plug connections with the foam sheets 18'. The concrete is then cured for a predetermined period of time. After the concrete 19 has cured for a predetermined time, a further form casing 31'' is placed over the bottom casing, which is already leveled at the top surface of the concrete layer 19 and a further layer of foam sheet material 18' is placed within the uppermost form casing 31'. Cavities 21' are again formed in the inner face 22' of the foam material and concrete 19' is poured thereover to form another panel. Several of these panels can be superposed and the advantage of this is that a minimum amount of space is required to cast the panels on site or in a production plant. If it is necessary to produce the panels quickly, after a very short curing time, a plastic sheet 40 is disposed over the top surface of the concrete layer 19 so that the concrete 19 does not adhere to the outer surface 25 of the foam sheet 18'.

Figure 8:
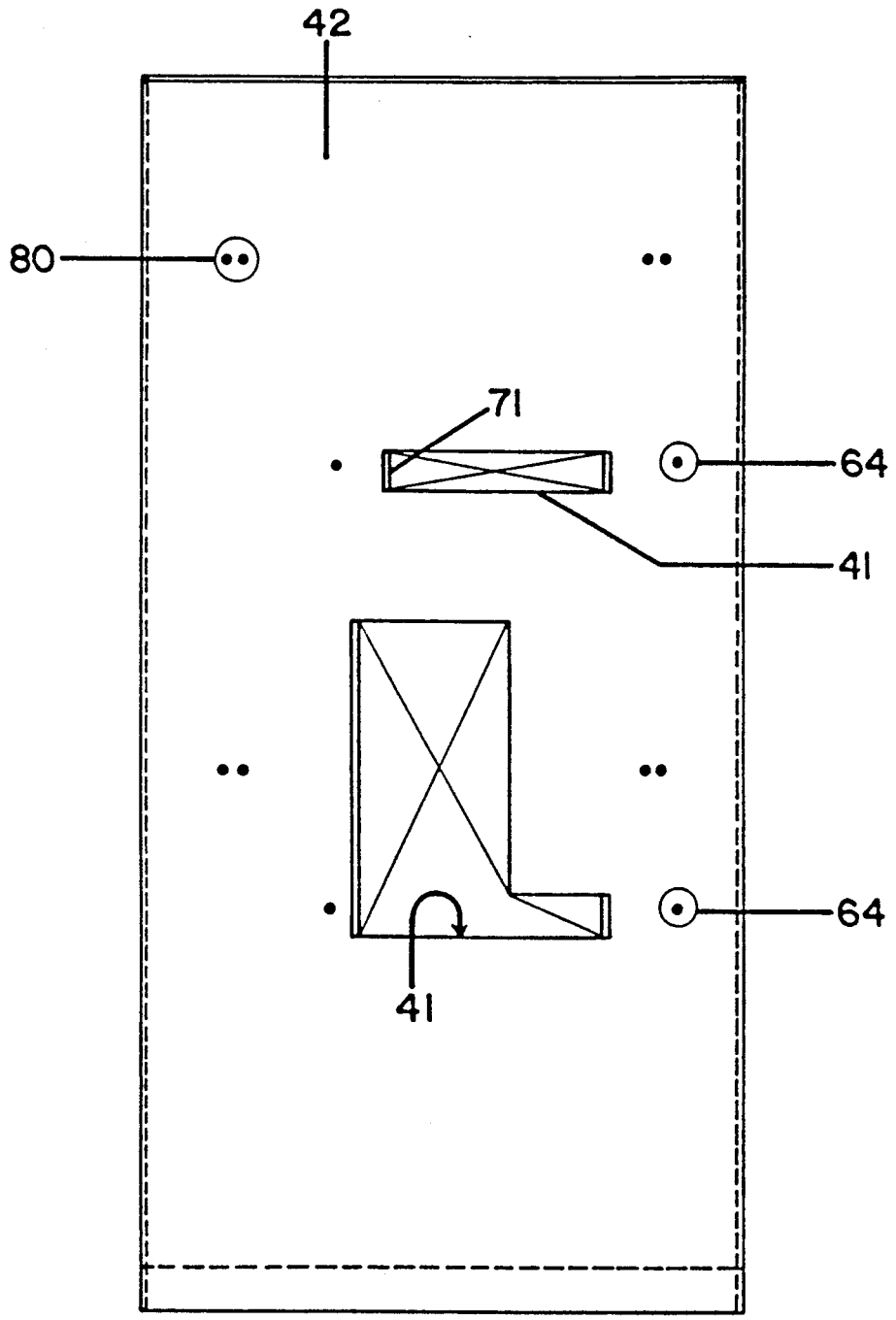
FIG. 8 is a plan view showing the configuration of a precast insulated concrete panel used as a vertical wall panel and used for supporting horizontal floor slabs.

As shown in FIG. 1, the outer precast insulated concrete panels 10 are provided with one or more horizontal slab receiving cavities 41 spaced apart along its outer face 19''. Such cavities 41 are illustrated in FIG. 8 which shows the configuration of a specific vertical wall panel 42 formed in accordance with the present invention.

Figure 9:
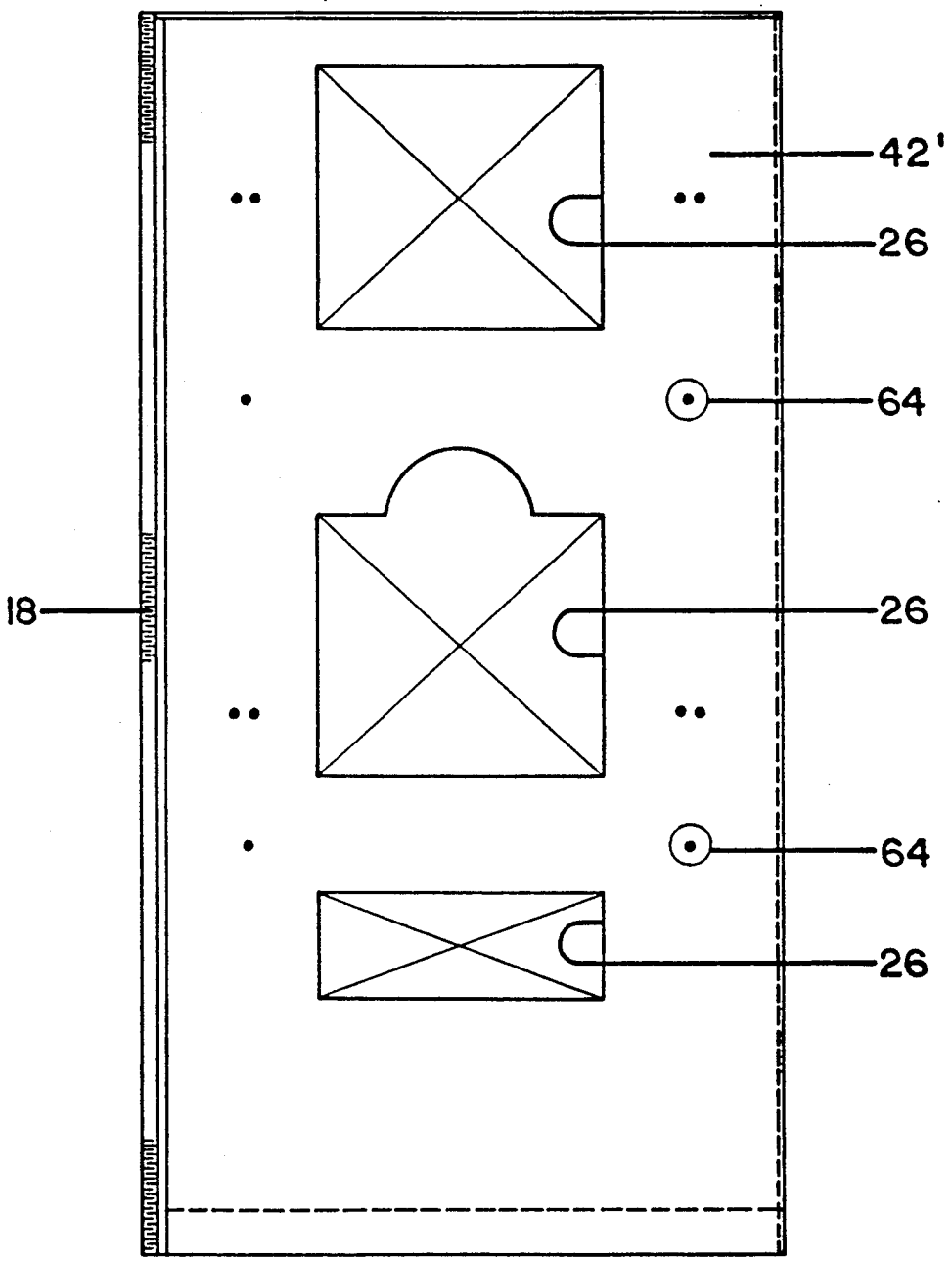
FIG. 9 is a view similar to FIG. 8 but illustrating a precast insulated concrete panel as used for a vertical wall panel which does not attach to the opposed end edges of a floor panel.
Figure 10:
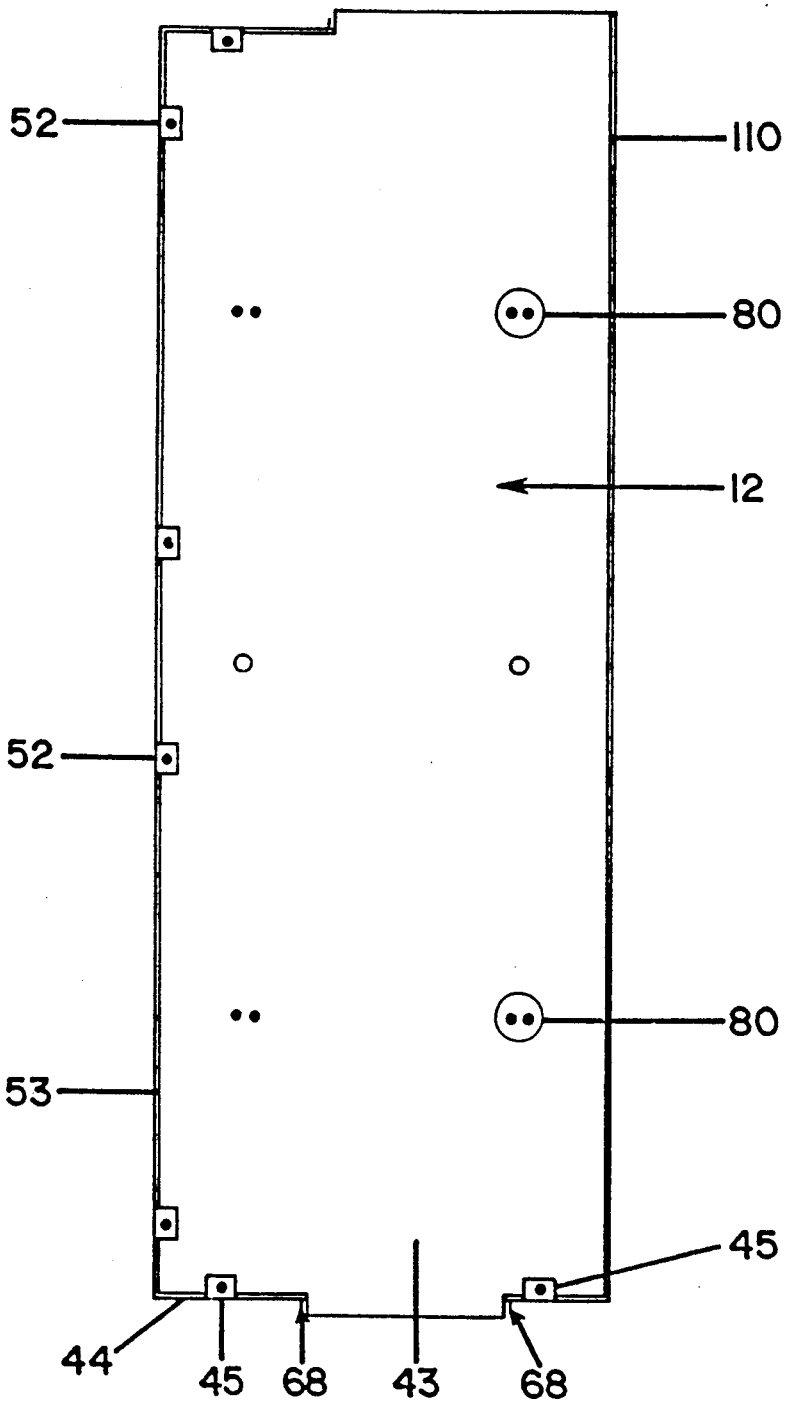
FIG. 10 is plan view of a floor slab having various connectors cast therein and for use with the precast insulated concrete panels of the present invention.

While further reference now to FIGS. 8 to 17, there will be described the manner in which the vertical wall panels are connected to the horizontal floor slabs 12. The floor slabs 12 and the vertical panels 10 are provided with connecting means in the form of steel connectors hidden from view. However, before describing concrete vertical wall panels 10 as shown in FIGS. 8 and 9, and in the floor slabs 12 as shown in FIG. 10, it is pointed out that the floor slabs have integral connecting extension flange sections 43 cast in opposed end edges 44 of the floor panels. These connecting extension flanges 43 fit within respective ones of the slab receiving cavities 41 formed in the vertical panels 42. End connectors 45 are formed on one or opposed sides of the extension flange 43 immediately adjacent the opposed end edges 44. Edge connectors 52, which one of the same construction as the connectors 45, also be formed in the side edges 53 of the floor slabs for connecting with an adjacent vertical wall. This is provided on floor slabs which are positioned adjacent vertical walls only.

Figure 14A:
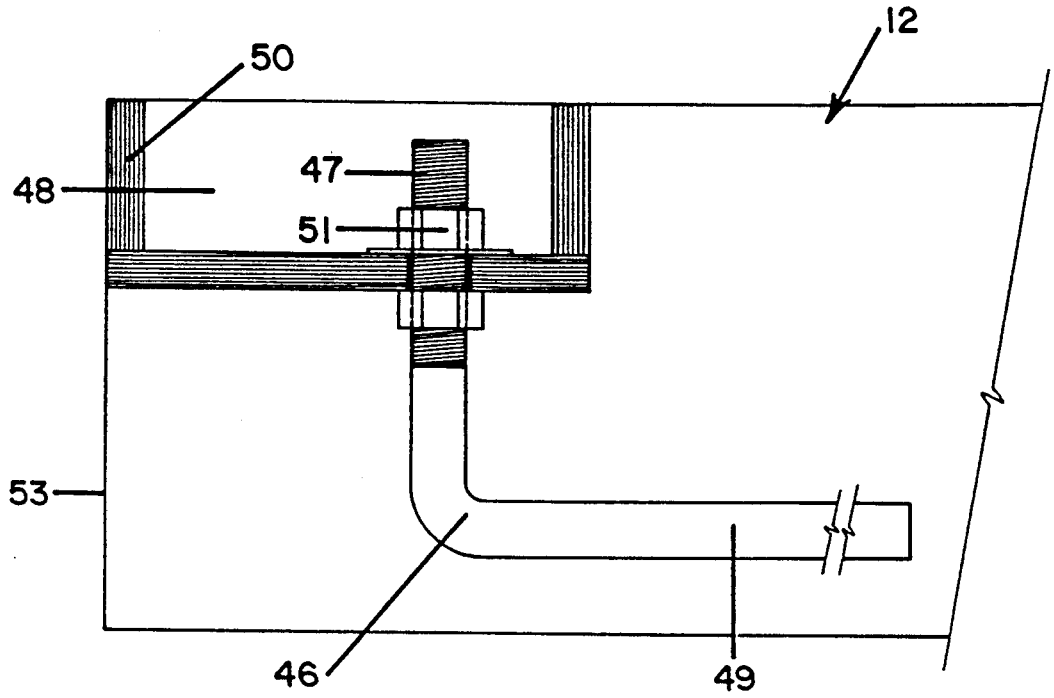
FIG. 14A is a sectional side view of a floor slab connecting anchor cast in the floor slab.
Figure 14B:
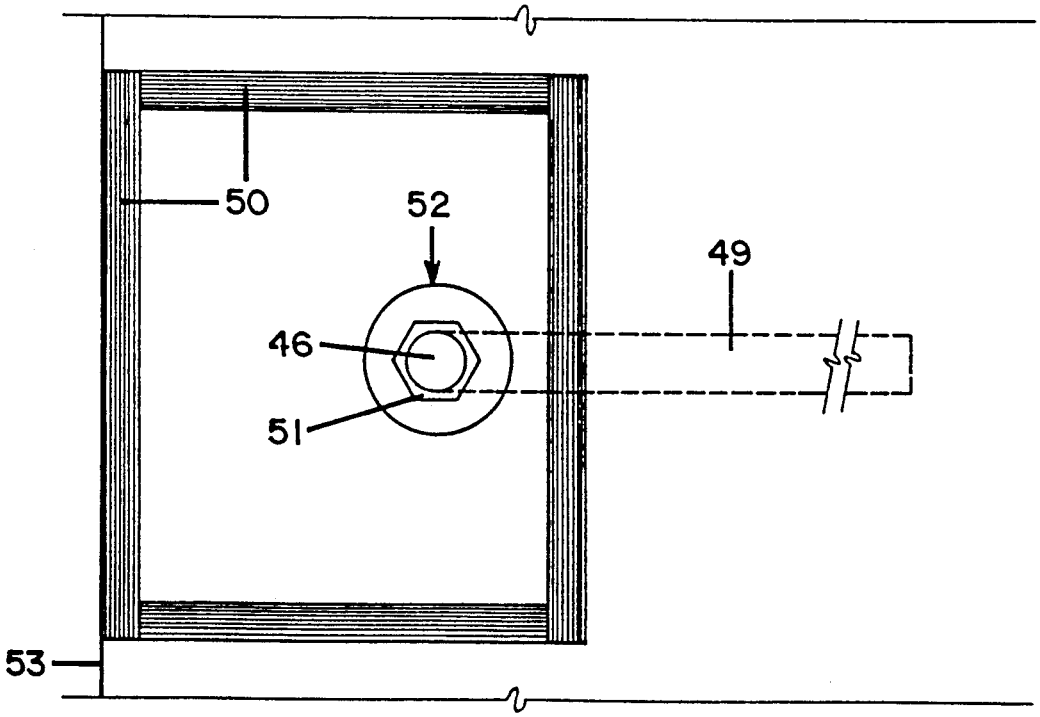
FIG. 14B is a top view of FIG. 14A.

Referring now to FIGS. 14A and 14B, there is shown the construction of these edge connectors 52. As herein shown, the edge connector is provided with a connecting bolt 46 which is cast in the concrete slab 12. The connecting bolt has an extension end 49 which extends a predetermined distance within the slab. The free end of the bolt 46 extends vertically into a connecting cavity 48 formed in a top outer end edge of the slab and the form 50 provides for this connecting cavity to open within the side edge 53. The bolt 46 has a threaded end portion 47 and a connecting nut 51.

Figure 15:
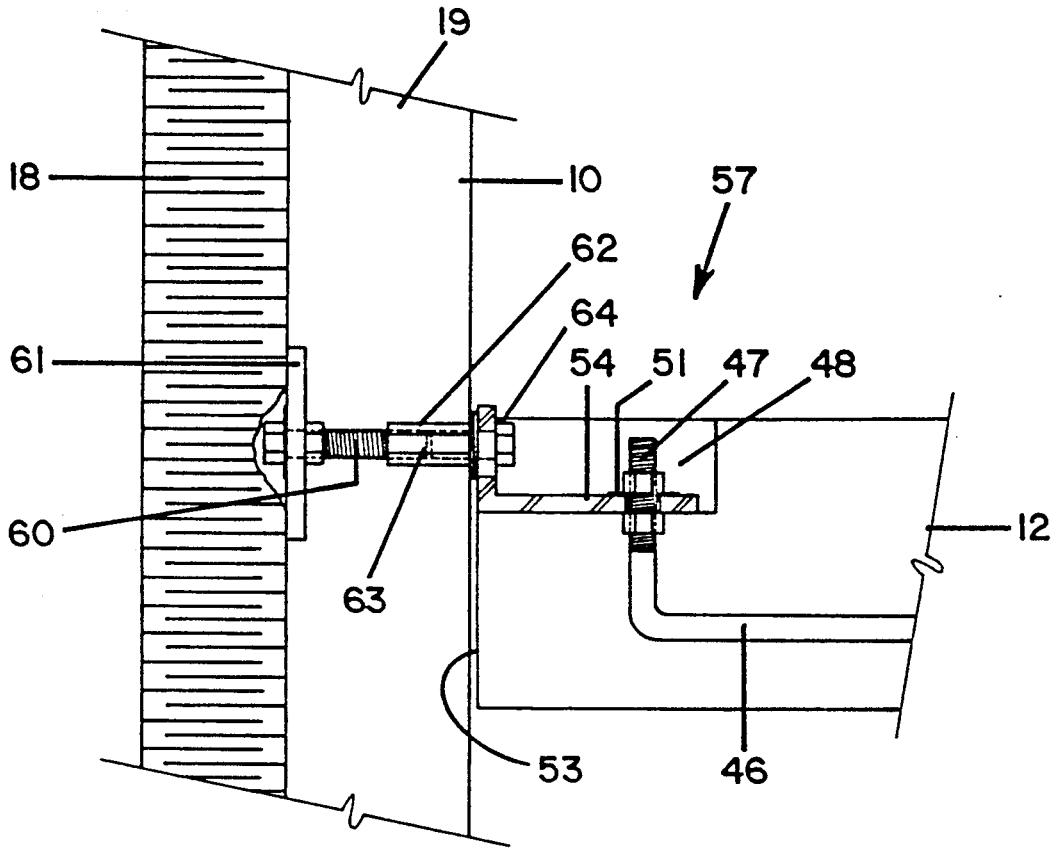
FIG. 15 is a side view showing the side interconnection of the floor slab to a vertical precast insulated concrete panel of the present invention and which permits adjustment and securement.
Figures 16A, 16B, 16C:
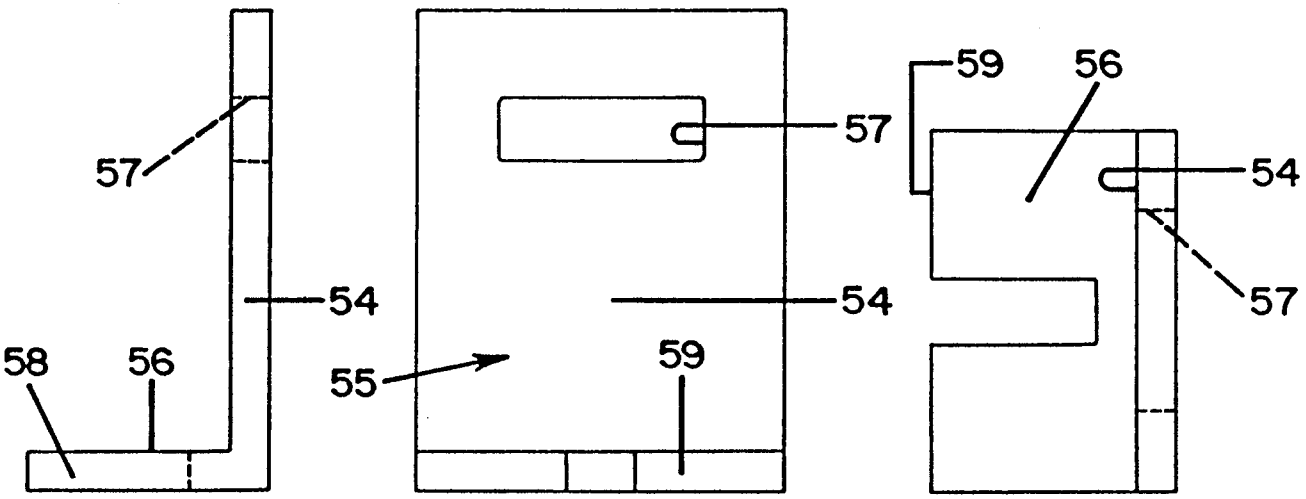
FIGS. 16A, 16B, and 16C are side, front and end views respectively of the right angle bracket as utilized in the connector construction of FIG. 15.

As shown in FIGS. 15 and 16, a connecting plate 54 is secured by the connecting bolt 46 to interconnect the floor slab 12 with a vertical wall panel 10 for adjustment thereof. The connecting flange 54 is an L-shape steel flange defining an attachment wall 55 and an integral right angle connecting wall 56. The connecting wall extends flush with the side edge 53 of the slab, as shown in FIG. 15. The attachment wall section is also provided with a slot aperture 57 to provide adjustment of the steel flange in the edge connecting cavity 48. The connecting bolt 46 extends through the slot 57. The connecting wall section 56 is also provided with a U-shape vertical slot 58 which extends from a top edge 59 thereof. As shown in FIG. 15, a connecting bolt assembly 60 is cast within the panel 10. The bolt assembly 60 is comprised of an end plate 61 secured or cast within the inner surface of the concrete layer 19 and is in threaded engagement with a connecting bushing 62. The connecting bushing has a threaded inner end 63 and receives a connecting bolt 64 therein. This connecting bolt 64 is utilized to connect with the connecting wall 56 of the L-shape steel flange 54. This also provides for adjustment of both the vertical wall panel 10 and the floor slab 12.

The end connectors 45 are constructed the same way as the edge connectors 52 and are connected to the connecting bolts 64 formed adjacent the slab receiving cavities 41, as shown in FIG. 8. FIG. 9 shows another vertical wall panel 42' having window openings 26 formed therein. It also has connecting bolts 64 threaded within the connecting bushings cast into these panels.

Figure 17A:
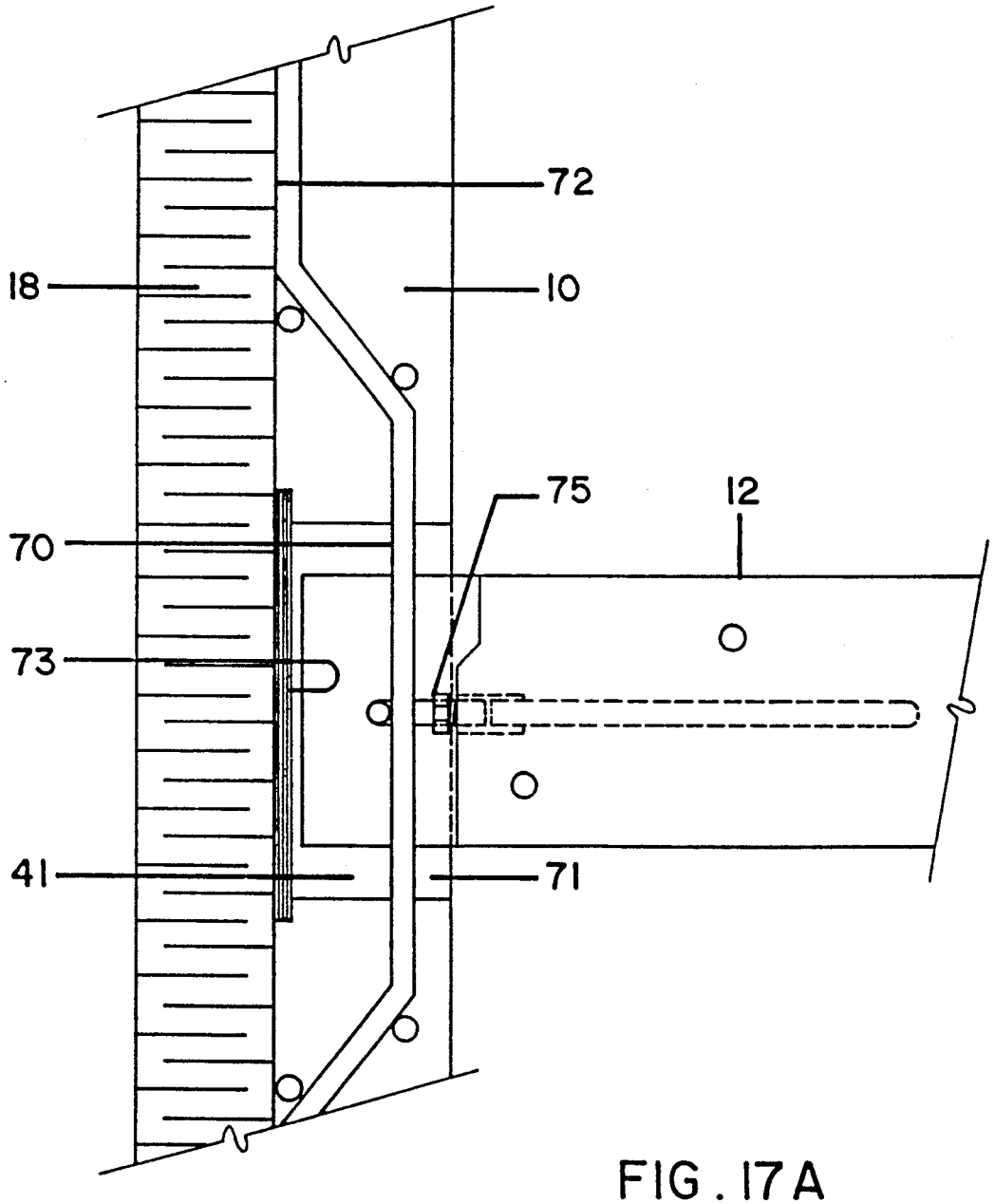
FIG. 17A is a side view showing the end connection of the floor slab to the vertical wall.

In order to provide positive support and retention of the floor slabs 12 to the vertical panels 10, the connecting extension flanges 43 of the floor slabs are located within the slab receiving cavities 41 of the vertical walls and connected therein. The connection means further comprises, as shown in FIG. 17A, one or more transverse steel rods 70, usually two per cavities, which extend vertically in the slab receiving cavities 41 adjacent the end walls 71 of the cavity. These transverse steel rods have extension ends 72 cast within the panel 10. They are also spaced from the rear wall 73 of the cavity 41.

Figure 17B:
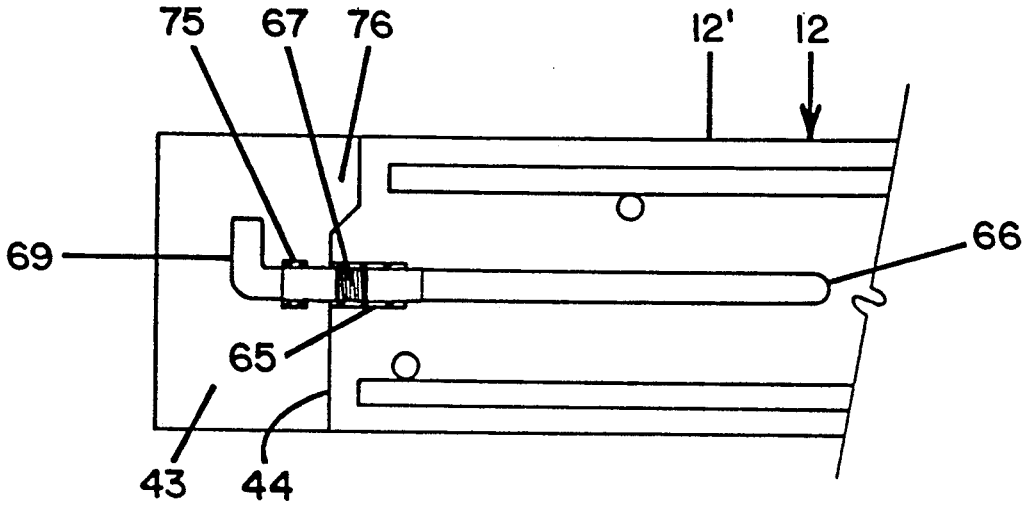
FIG. 17B is a sectional side view showing part of the end connector as cast in the floor slab.
Figure 17C:
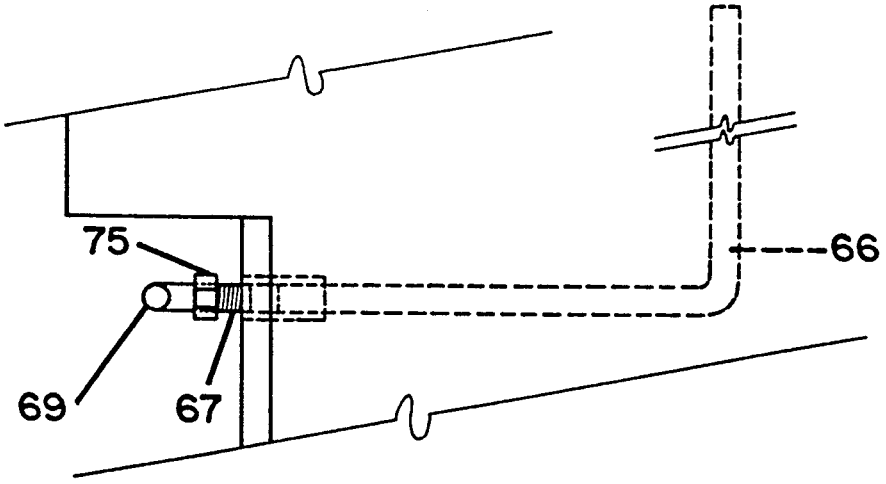
FIG. 17C is a top view of FIG. 17B.
Figure 18:
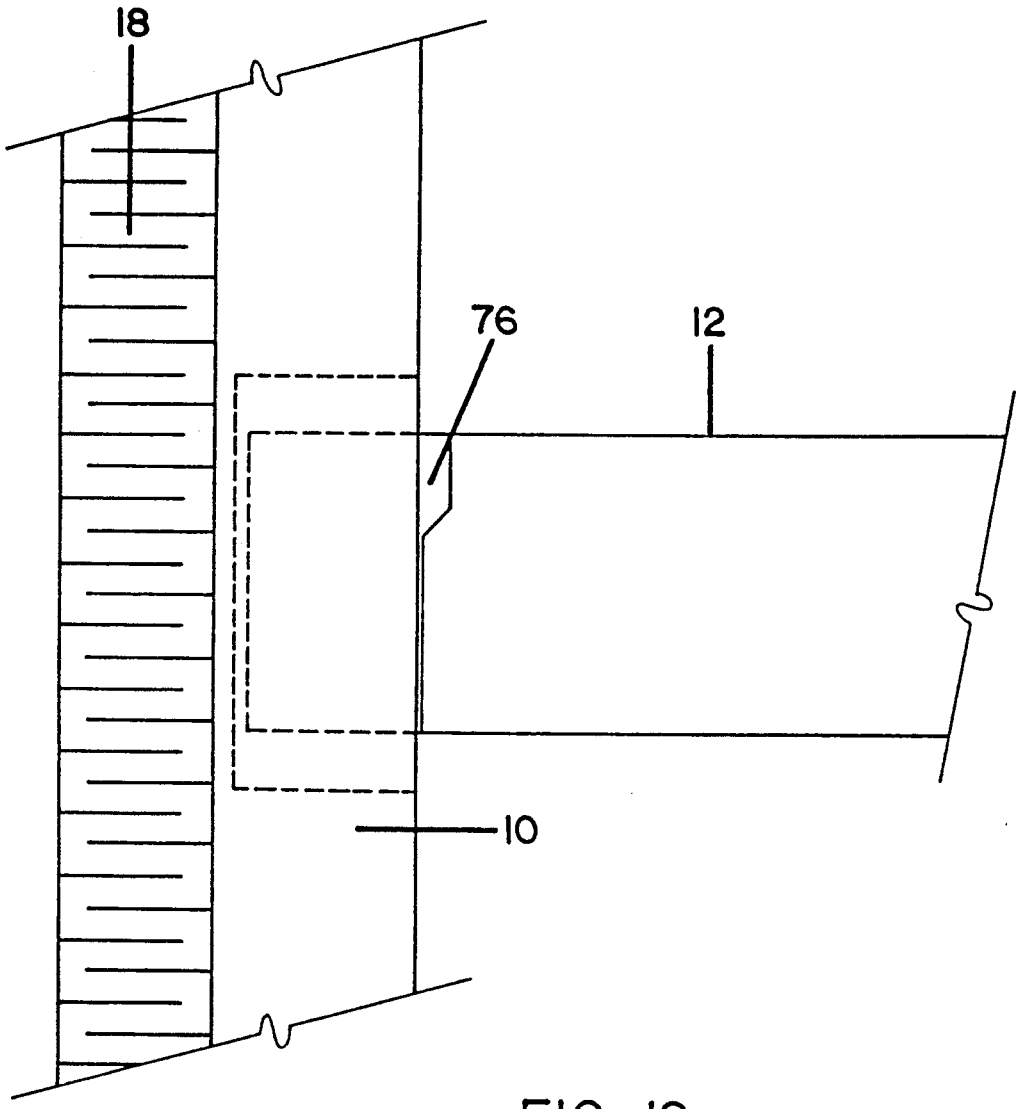
FIG. 18 is a section view similar to FIG. 17A illustrating the gap formed in the floor slab to secure the end connector of FIG. 17A.

As shown in FIGS. 17B and 17C, the floor slab 12 is also provided with a connecting sleeve 65 cast within the side edge 44 spaced closely to the connecting extension flange 43. The connecting sleeve 65 is connected internally to a reinforcing connecting rod 66 which is cast within the floor slab 12 to prevent the connecting sleeve bushing 65 from rotating. The bushing has a threaded inner end 67 which is in threaded engagement with a connecting bolt 68. The connecting bolt 68 has an engaging right angle head section 69 for abutting or grasping an associated one of the transverse steel rods and located between its associated steel rod 70 and the rear wall 73 of the cavity 41, as shown in FIG. 17A. The connecting bolt 68 is further provided with a counter nut 75 intermediate the bolt threaded section and the head section 69. As shown in FIG. 17B, the floor slab 12 is cast with a recess edge 76 adjacent the flange 43 and in the top surface 12' thereof. This recess edge permits access to the nut 75 so that a wrench or similar tool can engage the nut to rotate the connecting bolt 68 to position the head section 69 adjacent and transverse to the tranverse steel rod 70. This is illustrated in FIG. 17A and as herein shown, the slab 12 is supported, by the scaffolding 13, elevated and extending from opposed upper and lower walls of the cavity 41. This recess edge 76 also facilitates the insertion of grout within the cavity 41 and the transverse steel rod 70, and head section 69 of the bolt to provide for reinforcement and rigid connection of the floor slab with the wall without the effect of rigid connect. Accordingly, there is no moment distribution in the wall from the floor slab.

Figure 11A:
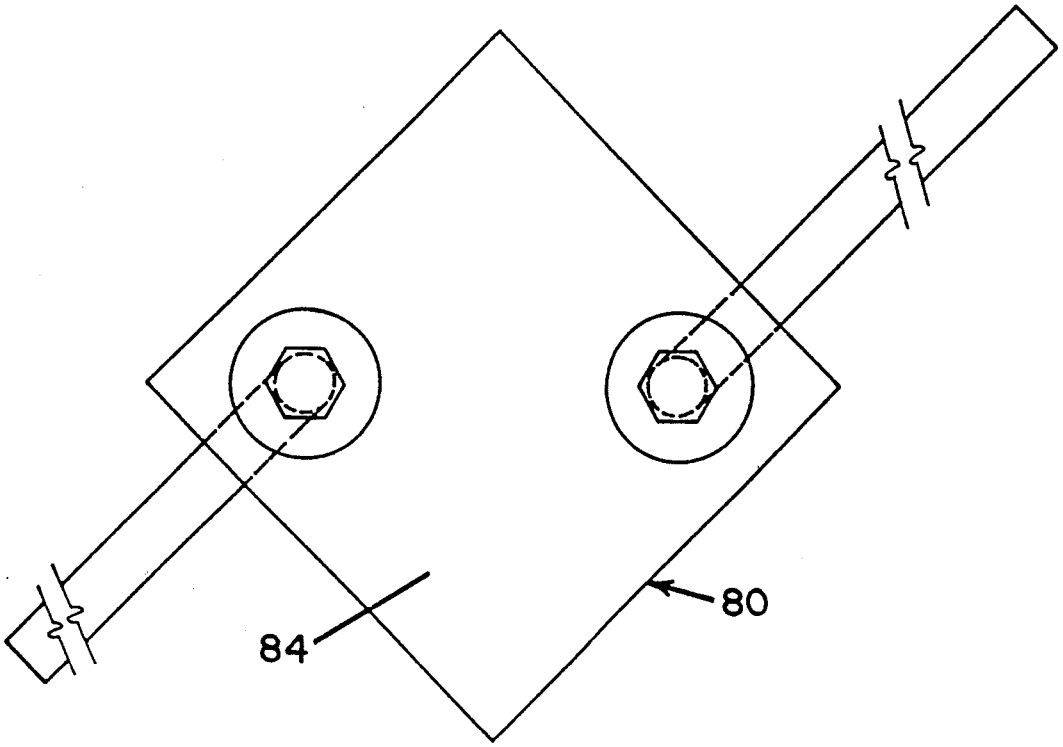
FIG. 11A is a top view of a floor anchor.
Figure 11B:
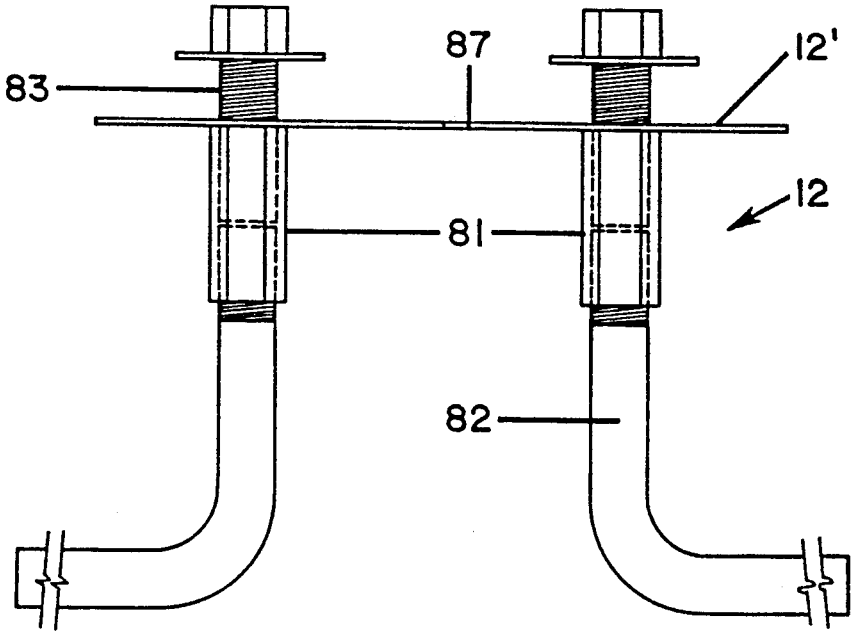
FIG. 11B is a sectional side view of the floor anchor of FIG. 11A.
Figure 12:
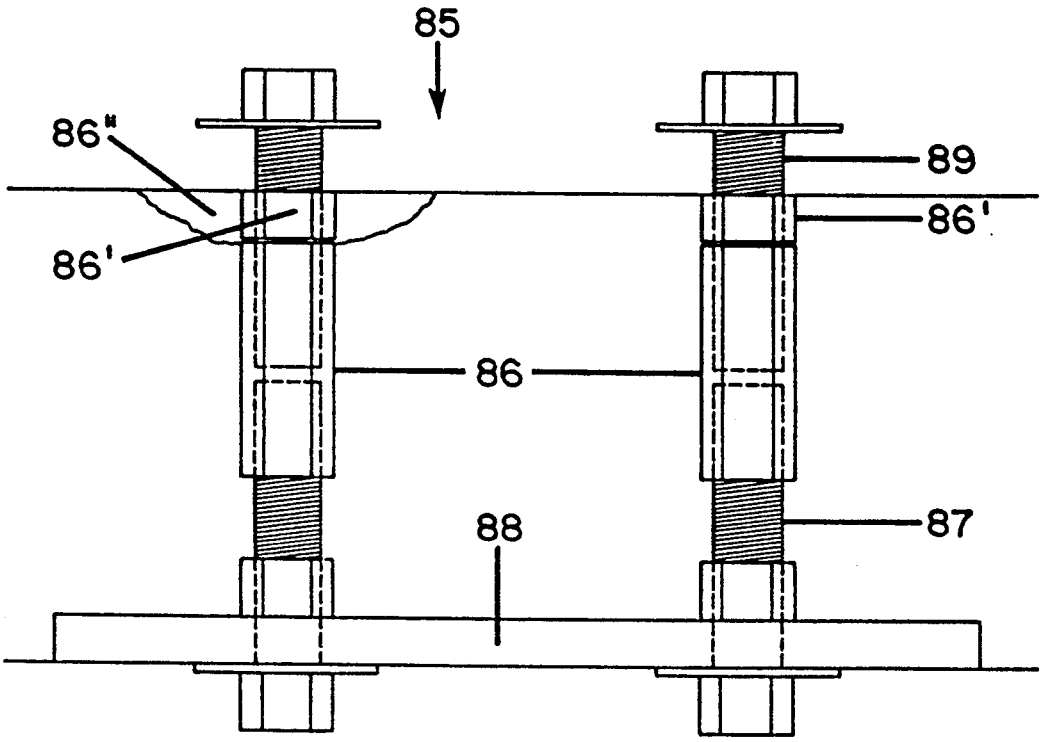
FIG. 12 is a side view showing a lifting anchor cast within the precast insulated concrete panels for lifting the panels into position.

Referring now to FIGS. 11 and 12, there is shown the construction of lift connectors which are cast within the panels 10 of the present invention and the floor slabs 12. The floor slab lift connectors 80 consist essentially of a pair of threaded bushings 81 anchored within the top surface 12' of the slab 12 and reinforced by reinforcing steel rods 82. Threaded connecting bolts 83 are in threaded engagement with the bushings 81. A floor plate 84 may be positioned over the concrete surface to protect the surface by the lift connector.

As shown in FIG. 12, the wall panel lift connector 85 consists also of a pair of main bushings 86 1 and small end bushings 86' held together by bolts 87 and cast within the concrete panel. Rectangular face plate 88 is also cast in place to provide reinforcement of the anchor. Anchor securing bolts 89 are in threaded engagement with the bushings 86 and 86'. It is to be noted that after the panels are in position, these bolts 89 are removed and used to snap off the end bushing 86' creating a cavity 86'' in which grout is inserted to conceal the bushings 86, particularly if the interior concrete surface is not covered with a finishing material as is to be exposed.

Figure 13A:
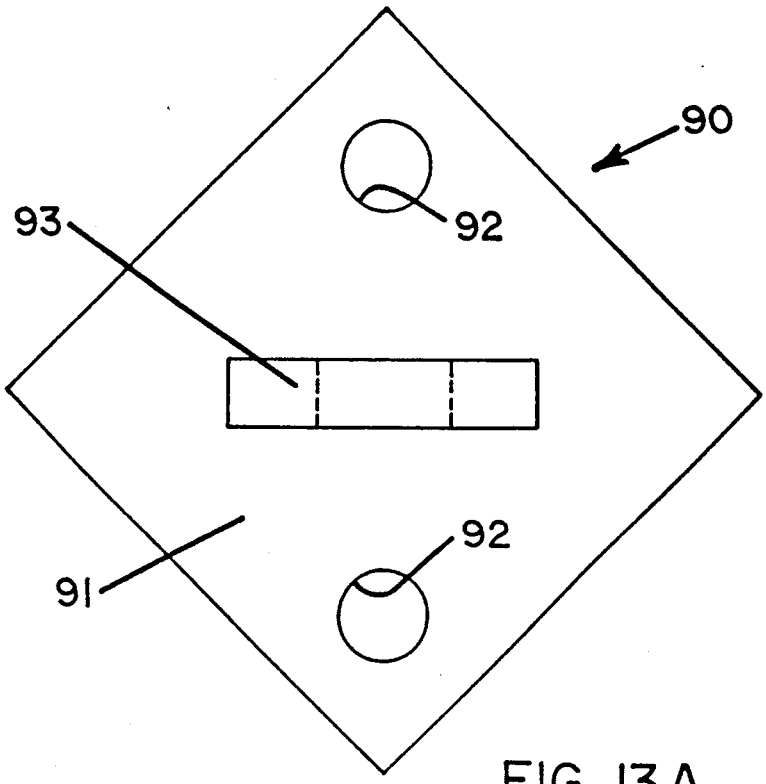
FIG. 13A is a top view of a lifting plate which is engaged with the anchors of FIGS. 11 and 12.
Figure 13B:
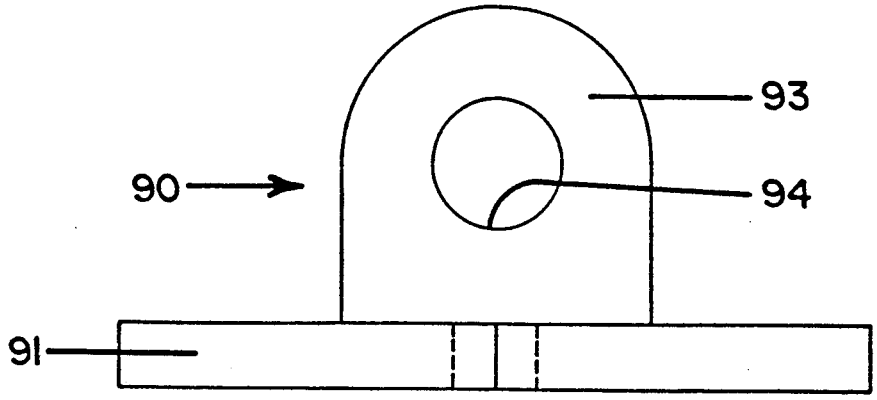
FIG. 13B is a side view of FIG. 13A.

FIGS. 13A and 13B illustrate the construction of a typical lifting plate, herein lifting plate 90 which is removably connected to these anchor bolts 83 or 89 to secure hooks (not shown) at the end of lifting cables 15. The lifting plate 90 consists of a reinforcing rectangular plate 91 having opposed connecting holes 92 therein for attaching the plate 91 to the surface of the floor slabs or the wall panels by means of the connecting bolts 83 or 89. An eye connector 93 extends vertically from the center of the plate 91 and has a hole 94 therein for connecting the cables to the floor slabs or wall panels.

Figure 20:
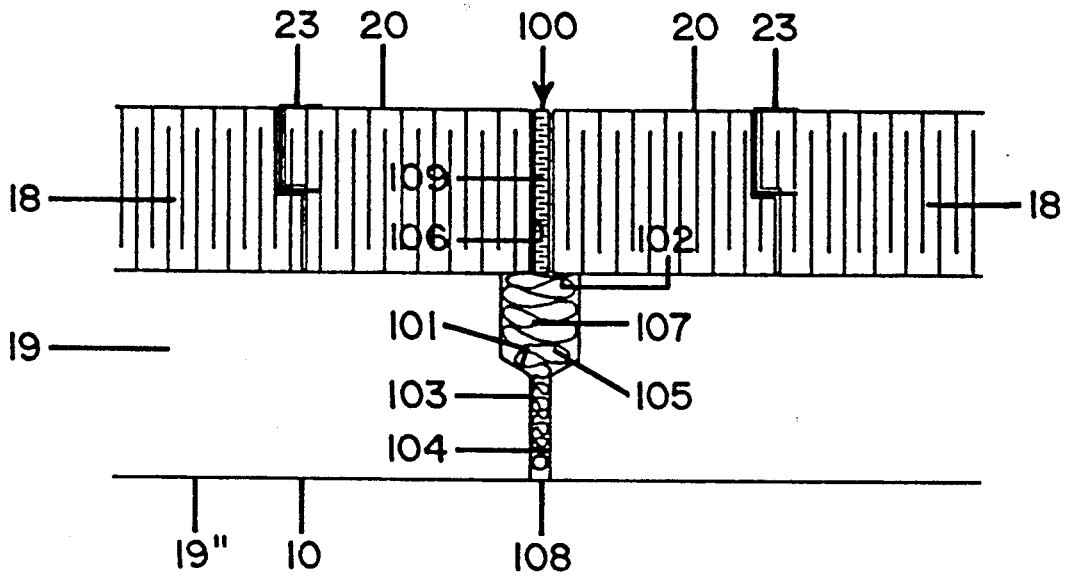
FIG. 20 is a cross-section view through opposed side edges of two vertical panels showing the manner in which the side edges are insulated.
Figure 21:
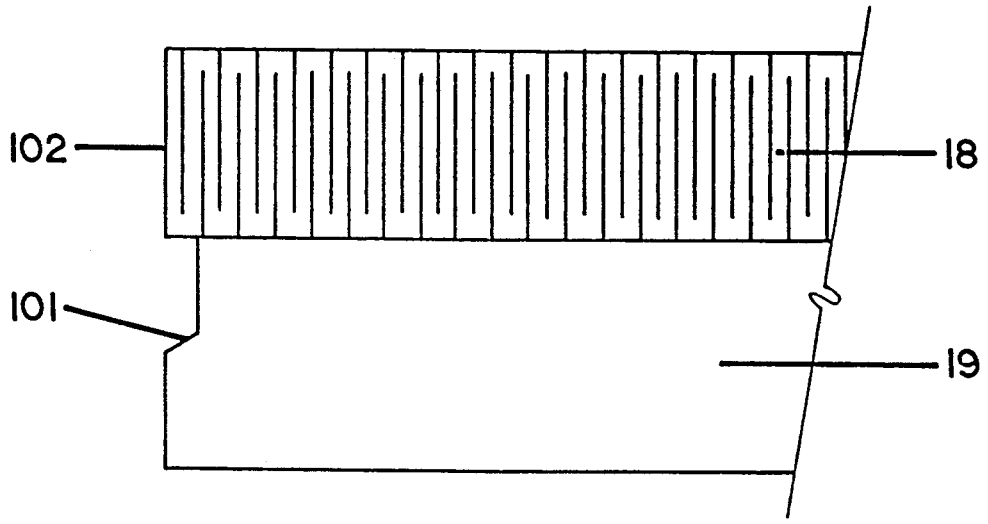
FIG. 21 is a vertical section view showing a connection of a vertical panel.

As shown in FIGS. 20 and 21, the exterior wall panels 20, when erected, define between their vertical edges a joint generally indicated by reference numeral 100. Each of the exterior panels 10 are cast with a vertical outer edge recess 101 in a portion of a vertical side edge of its concrete layer. The sheet of insulating material 18 overhangs the edge recess as shown at 102 and terminates flush with the vertical side 103 of the panels. When the panels are aligned side by side, as shown in FIG. 20, the joint 100 defines a pocket area 105 between the edge recesses 101 of adjacent panels and a narrow slot 104 rearwardly thereof. The overhanging insulating material section 102 also defines a narrow slot 106 therebetween as herein shown. The pocket area 105 is filled with an insulating fiber or wool type material 107, and a caulking bead or foam insulating tape 108 closes the slot 104 from the interior surface 19'' of the concrete layer 19 of the panel. The exterior slot 106 between the insulating foam sheets 18 is sealed by wedging a foam sheet 109 therebetween. Accordingly, the edge joints between the vertical wall panels is well insulated.

Figure 19:
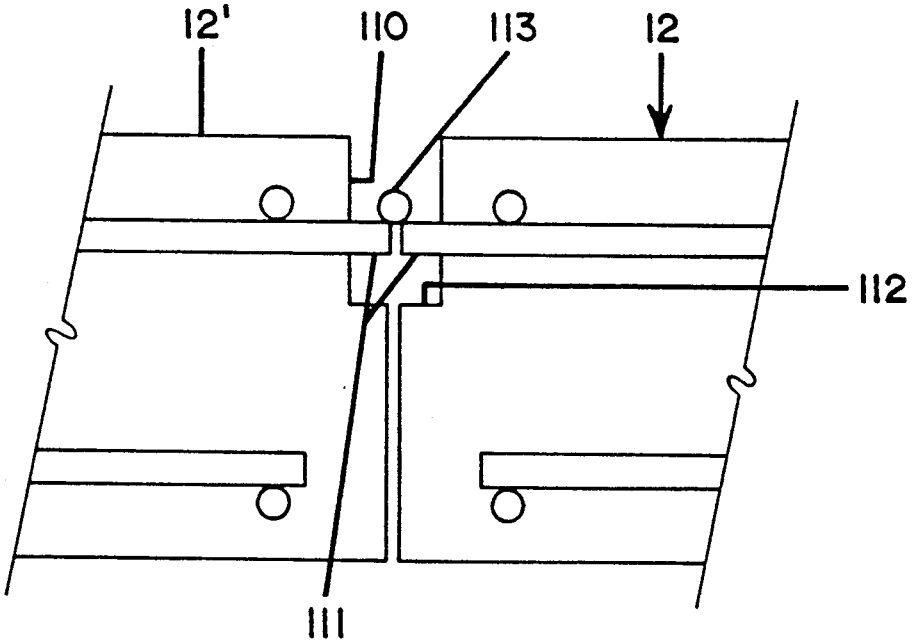
FIG. 19 is a section view showing longitudinal side edges of adjacent floor panels and the interconnection thereof.

As shown in FIG. 19, the floor slabs 12 are also formed with a top connecting recess 110 in an exterior side edge thereof. The recess 110 extends from the top surface 12' of the floor slabs. A reinforcing rod end 111 protrudes in the top connecting recess 110 and spaced from a bottom wall 112 of the recess. When the floor slabs are assembled, they are closely spaced as shown in FIG. 19 with the recesses 110 of adjacent slabs being aligned in a common plane. A transverse reinforcing steel rod 113 is then welded to the rod ends 111 and grout is poured into the cavity. The rod ends and the transverse reinforcing steel rods provide for a reinforced connecting joint between adjacent floor slabs.

Figure 22:
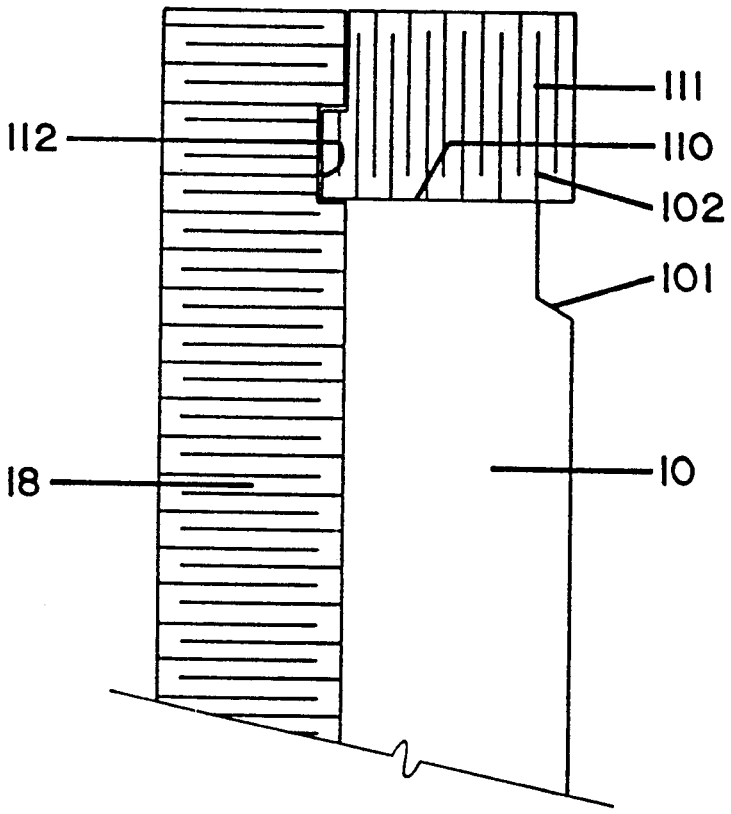
FIG. 22 is a vertical section view showing an outer wall corner of a vertical wall panel.

Referring now to FIG. 22, there is shown the configuration of the outer side edge 110 of a panel 10 when the panel is positioned at the corner of a building structure. The outer side edge 110 is herein formed with an insulating foam cap 111 which is connected to the foam sheet 18 through a connecting cavity 112. This foam cap also has an extension 102 as previously described to cooperate with the recess 101 to form a sealed joint with an adjacent transverse panel.

Figure 23:
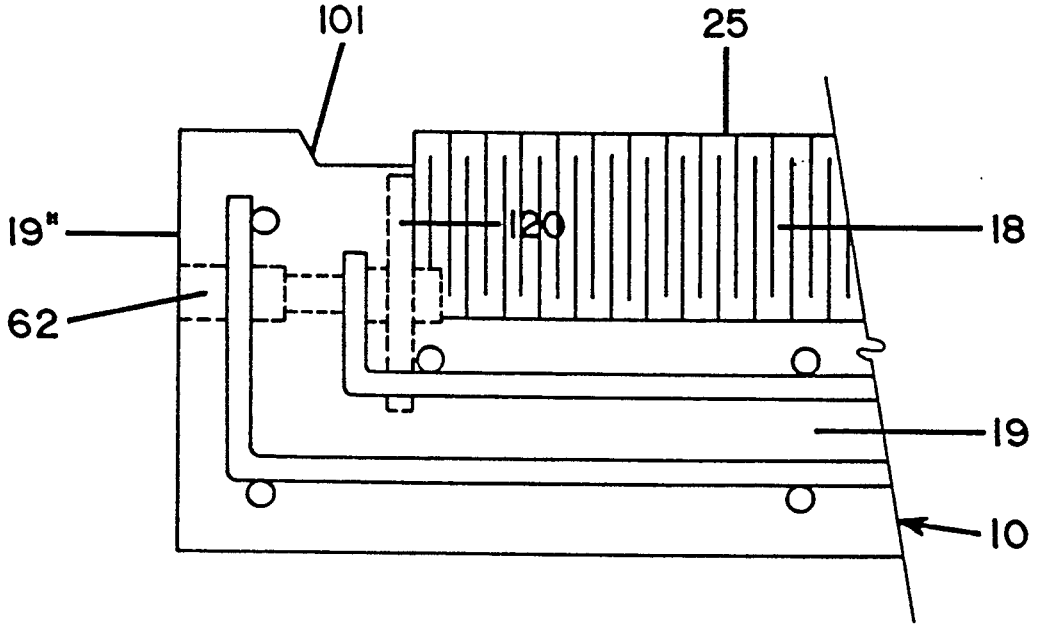
FIG. 23 is a vertical section view showing an inside portion of an inside corner of an outer vertical wall.

FIG. 23 shows the construction of the panel to form an inside corner of a building structure. As herein shown, the panel is cast with a right angle extension portion 120. As further shown, the extension portion has a connecting bushing 62 cast therein for permitting adjustment with a floor slab. An edge recess 101 is also formed in the edge of the right angle section 120 to provide an insulating joint. This recess is aligned with the top outer surface 25 of the insulating sheet 18 and an insulating joint as shown in FIG. 20 is made.

Figure 24:
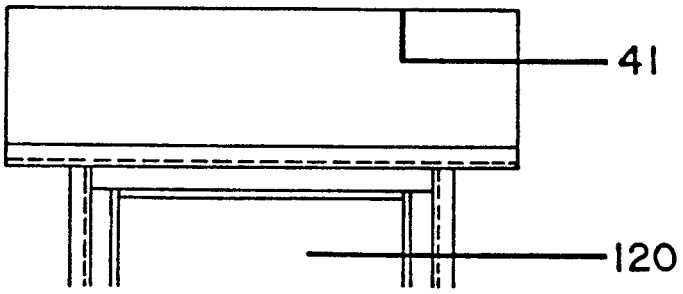
FIG. 24 is a plan view showing a vertical panel connecting cavity positioned over a window opening.
Figure 25:
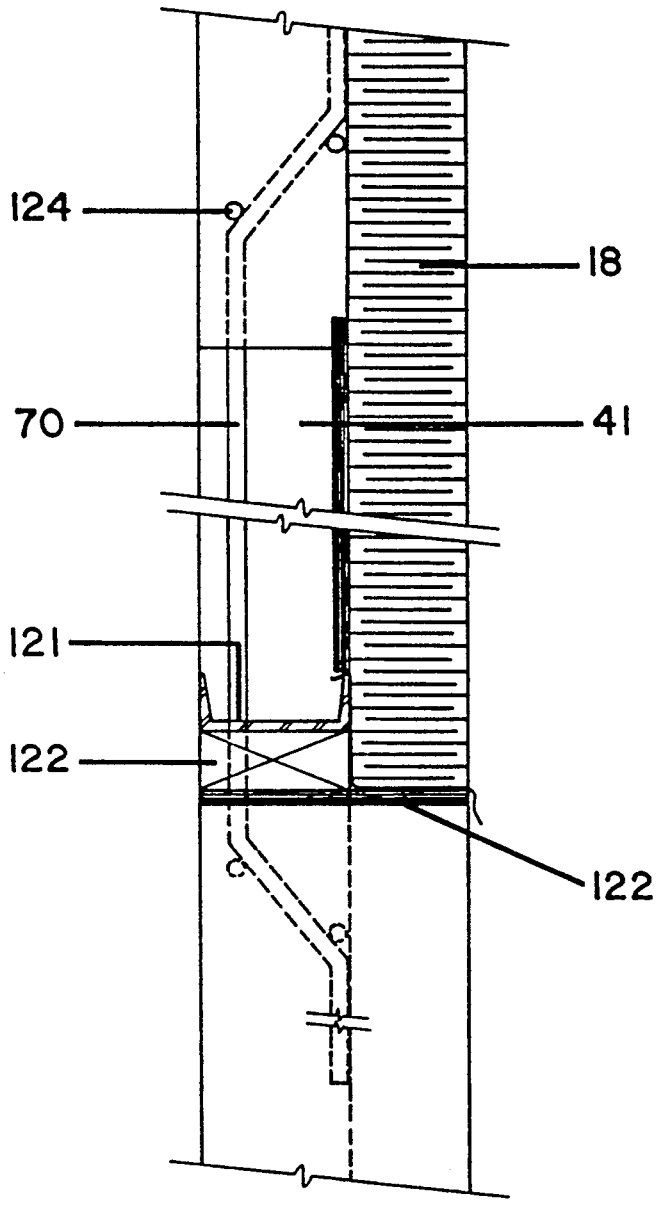
FIG. 25 is an enlarged section view through the connecting cavity showing the framing of a window opening.
Figure 26:
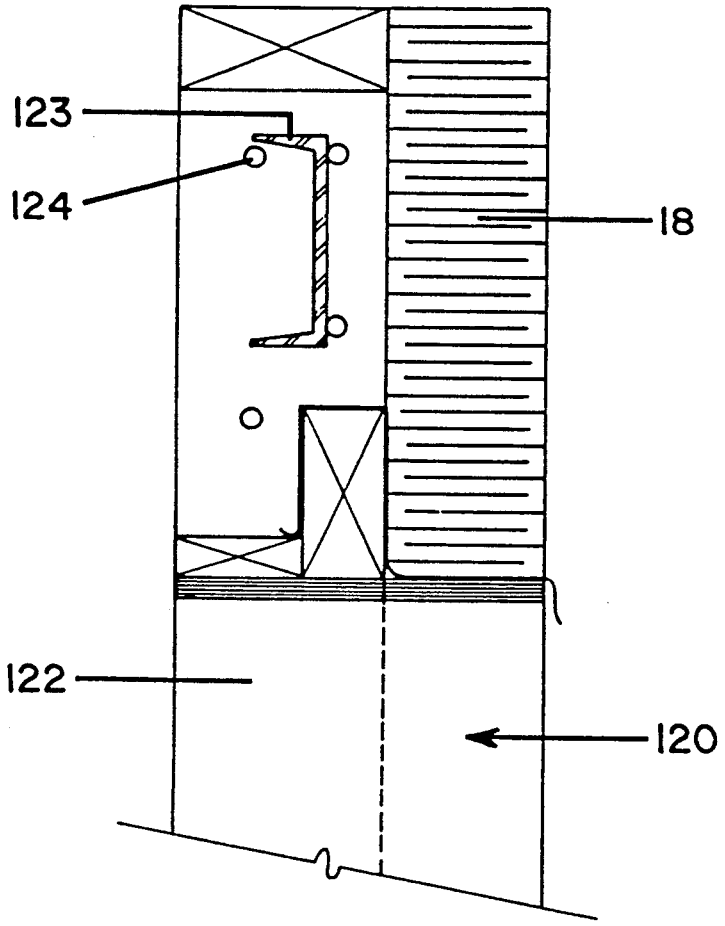
FIG. 26 is a side section view showing a reinforcement in the top wall portion of an opening.

FIGS. 24 to 26 illustrate a typical reinforcement of window or door openings and a formation of a slab receiving cavity 41 disposed above a window opening. To reinforce the window opening 120, a steel channel member 121 is cast into the panel above the window opening and forms the base wall of the slab connecting cavity 41. A nailing casing 122 is also inserted within the mould casing or can be installed after the panel is cast with an opening. This provides a nailing surface for the installation of a window unit therein, not shown. As herein shown, a transverse steel rod 70 extends through the cavity 41 for connecting with the slab 12, as previously described.

FIG. 26 also illustrates another arrangement where reinforcement steel channel section 123 is cast within the panel 10 and spans the window opening 120. Reinforcing steel rods 124 also extend within the concrete.

Summarizing the construction of the building structure utilizing the precast insulated concrete panels of the present invention, the site where the building structure is to be erected is prepared to provide level areas to cast concrete panels on site, if this is required. If not, a footing is poured as well as a level support floor surface 14, as shown in FIG. 1, and the concrete floor slabs 12 are supported in position by the scaffolding 13. The vertical panels 10 are then tilted into position and the connectors as shown in FIGS. 14, 15 are interconnected when structural connections are secured and the open joints are grouted. The joints between the vertical panels are insulated and sealed. The roofing is framed and completed and the window and door openings are sealed by windows and doors units. The interior fisnish 140 as shown in FIG. 3 is then applied to the insulating panels or erected of the footings. The inner walls are given a surface treatment or covering after the wiring and ducting has been completed. It is pointed out that the precast concrete panels as well as the floor slabs are cast with the necessary conduits and channels for electrical wiring, communication wiring and water and heating conduits. The precast insulated concrete panels of the present invention as well as the construction method provides several advantages as previously described and permit buildings to be erected very quickly and also important to note that it provides for well insulated and sound structural buildings.

It is within the ambit of the present invention to cover any obvious modifications of the preferred embodiments described therein, provided such modifications fall within the scope of the appended claims.

What is claimed is:

1. A precast insulated structural concrete panel for use in a building structure, said panel comprising an outer insulating skin formed by a rigid continuous layer of insulating sheet foam material, said insulating sheet foam material having a plurality of spaced apart, discrete connecting cavities formed throughout an inner surface thereof, and a concrete layer formed on said inner surface of said foam material, said concrete layer forming integral concrete plugs for connection to said insulating sheet foam material by concrete extending in said connecting cavities, said panel circumferential edges having a predetermined thickness of concrete covered by a predetermined thickness of said insulating foam material so that when said panel is interconnected with others of said panel a continuous insulating outer barrier is obtained over the panels, connecting means to interconnect said panel with other construction elements of said building structure, said insulated structural concrete panel being an exterior panel for a building structure.

2. A precast insulated structural concrete panel as claimed in claim 1 wherein there is further provided a plurality of attachment elements secured to said rigid sheet of insulating material and spaced from said concrete inner wall, said attachment elements having an exterior connecting flange element for securing exterior finishing material thereto.

3. A precast insulated structural concrete panel as claimed in claim 2 wherein said attachment elements are U-shaped metal inserts which are positioned and secured in a joint formed by adjoining insulating sheets forming insulating skin.

4. A precast insulated structural concrete panel as claimed in claim 1 wherein said insulated concrete panels having one or more horizontal slab receiving cavities in said concrete inner layer for receiving a support end of one or more horizontal floor slabs, said connecting means being connected inside said slab receiving cavities.

5. A precast insulated structural concrete panel as claimed in claim 4 wherein said connecting means is comprised of one or more transverse steel rods extending in said slab receiving cavity and spaced from a rear wall of said cavity, said floor slab having a connecting extension flange section formed integral in a connecting edge thereof, a connecting bolt in threaded engagement in a connector sleeve cast in said connecting edge adjacent said extension flange section, said connecting bolt having an engaging head section for connection with an associated one of said transverse steel rods between said associated steel rod and said rear wall of said cavity, and tool engaging means secured to said connecting bolt to impart axial rotation and displacement thereof.

6. A precast insulated structural concrete panel as claimed in claim 5 wherein an anchor rod is connected to an internal end of said connector sleeve and cast into said panel.

7. A precast insulated structural concrete panel as claimed in claim 5 wherein said floor slab is cast with a recessed edge portion in said connecting edge adjacent said extension flange section to provide an access opening to said tool engaging means when said extension flange section is disposed in said slab receiving cavity.

8. A precast insulated structural concrete panel as claimed in claim 7 wherein said tool engaging means is a counter-nut secured to said connecting bolt forwardly of a threaded section thereof, said engaging head being constituted by a right-angle free end section of said bolt, said support end of said floor slab being secured in said slab receiving cavity by grout and said engaging head section of said connecting bolt and transverse steel rods.

9. A precast insulated structural concrete panel as claimed in claim 4 wherein said connecting means further comprise two or more adjustable wall connectors for interconnecting said exterior panel to said one or more floor slabs, each said adjustable wall connectors comprising an L-shaped steel flange having an attachment wall secured in an edge cavity of said floor slab and a right-angle connecting wall extending flush with a side edge of said floor slab, said attachment wall having a slot aperture to provide adjustment of said steel flange in said edge cavity, a connecting anchor bolt extending through said slot aperture, said connecting wall having a U-shaped vertical slot extending from a top edge thereof, and a connecting bolt extending in said U-shaped slot and in threaded engagement with a threaded bushing cast in an inner surface of said exterior panel adjacent said edge cavity.

10. A precast insulated structural concrete panel as claimed in claim 9 wherein said threaded bushing is a threaded sleeve cast in said exterior panel and reinforced by a threaded anchor bolt in threaded engagement with an inner end thereof, said anchor bolt extending through and connected with an anchor plate cast in said concrete layer in an inner surface in contact with said inner surface of said insulating material.

11. A precast insulated structural concrete panel as claimed in claim 4 wherein there is a plurality of said exterior panels, said panels defining insulated vertical joints therebetween, each said exterior panels being cast with a vertical edge recess in a portion of a vertical side edge of said concrete layer, said sheet of insulating material overhanging said edge recess and terminating flush with said vertical side edge, said exterior panels being supported vertically in closely spaced relationship and defining a vertical joint therebetween, said joint defining a pocket area between said edge recess of adjacent panels and a narrow slot rearwardly thereof with said overhanging insulating material also having a narrow slot, said pocket and narrow slots being sealed with thermal insulating material.

12. A precast insulated structural concrete panel as claimed in claim 4 wherein said floor slabs are provided with a top connecting recess in an interior side edge thereof, said recess extending from a top face of said floor slab, and reinforcing rod ends protruding in said top connecting recess intermediate said top face and a bottom wall of said recess, said floor slabs being closely spaced with said recess of an adjacent floor slab aligned in a common plane, and a transverse reinforcing steel rod connected to said rod ends above their extremities, and a grout disposed in said aligned recesses to connect said rod ends and said transverse rod.

13. A precast insulated structural concrete panel as claimed in claim 4 wherein some of said exterior panels are cast with large openings therein for windows and doors, said panels having reinforcing steel channel sections cast therein and spanning a top end of said large openings, said openings being cast with nailing stud casings to secure windows and door frames in said openings.

14. A precast insulated structural concrete panel as claimed in claim 4 wherein said exterior panels and floor slabs are cast with lift connector bolts, and a lifting plate removably securable to said lift connector bolts, said lifting plate having an eye-connector for attachment to a hook end of crane lifting cables.

* * * * *